US006291911B1

(12) United States Patent
Dunk et al.

(10) Patent No.: US 6,291,911 B1
(45) Date of Patent: Sep. 18, 2001

(54) ELECTRICAL SWITCHGEAR WITH SYNCHRONOUS CONTROL SYSTEM AND ACTUATOR

(75) Inventors: Michael Peter Dunk, Caledonia; John Francis Baranowski, Franklin, both of WI (US)

(73) Assignee: Cooper Industries, Inc., Houston, TX (US)

( * ) Notice: Subject to any disclaimer, the term of this patent is extended or adjusted under 35 U.S.C. 154(b) by 0 days.

(21) Appl. No.: 09/104,377

(22) Filed: Jun. 25, 1998

Related U.S. Application Data

(63) Continuation-in-part of application No. 08/440,783, filed on May 15, 1995, now abandoned.

(51) Int. Cl.[7] ..... H01H 33/66
(52) U.S. Cl. ..... 307/137; 361/152; 361/154
(58) Field of Search ..... 307/137; 361/152–156, 361/160

(56) References Cited

U.S. PATENT DOCUMENTS

| | | | |
|---|---|---|---|
| Re. 30,134 | 10/1979 | McClain et al. . | |
| 3,562,682 | 2/1971 | Ohwada et al. . | |
| 3,792,390 | 2/1974 | Boyd . | |
| 3,917,987 | 11/1975 | Inoue . | |
| 3,946,277 | 3/1976 | Lange et al. . | |
| 4,027,203 | 5/1977 | Moran et al. . | |
| 4,124,790 | 11/1978 | Kumbera et al. . | |
| 4,247,879 | 1/1981 | Elms et al. . | |
| 4,351,012 | 9/1982 | Elms et al. . | |
| 4,387,280 | 6/1983 | Iman . | |
| 4,429,197 | 1/1984 | Sakuma et al. . | |
| 4,434,450 * | 2/1984 | Gareis | 361/152 |
| 4,535,409 | 8/1985 | Jindrick et al. . | |
| 4,568,804 | 2/1986 | Luehring . | |
| 4,625,189 | 11/1986 | Lazar et al. . | |
| 4,725,799 | 2/1988 | Bratkowski et al. . | |

(List continued on next page.)

FOREIGN PATENT DOCUMENTS

| | | | |
|---|---|---|---|
| 2601799 | 7/1977 | (DE) . | |
| 32 24 165 | 12/1983 | (DE) | H01H/3/28 |
| 0528357 | 2/1993 | (EP) . | |
| 2 488 036 | 2/1982 | (FR) | H01F/7/18 |
| 58-090139 | 5/1983 | (JP) . | |
| WO 92/01303 | 1/1992 | (WO) | H01H/33/59 |
| WO 9323760 | 11/1993 | (WO) . | |
| WO 95 28025 | 10/1995 | (WO) . | |
| WO 96/36982 | 11/1996 | (WO) | H01H/33/66 |

OTHER PUBLICATIONS

Passey et al.; "Arc Suppression of a DC Energized Contactor Under Inductive Load"; *IEEE Transactions–On Industry Applications*, vol. 1A–2I; No. 6; pp. 1354–1358; Nov.–Dec. 1985.

(List continued on next page.)

*Primary Examiner*—Fritz Fleming
(74) *Attorney, Agent, or Firm*—Fish & Richardson P.C.

(57) ABSTRACT

In a power distribution system, synchronizing switchgear operations with an AC voltage or current waveform can be accomplished more precisely with a closed-loop feedback, microprocessor-based motion control design. By employing a closed-loop feedback, microprocessor-based design, switchgear contact position and velocity can be monitored and optimized in real time during a switching operation, thereby assuring a more accurate switching operation. Moreover, the closed-loop feedback design intrinsically compensates for the effects of such things as ambient temperature, AC waveform fluctuations, and changes in the physical condition of the switchgear. The closed-loop position feedback design is also capable of optimizing various transfer function parameters associated with the closed-loop feedback process, both during and subsequent to a switching operation, to further assure that switching operations are more accurately synchronized with the AC voltage or current waveforms.

48 Claims, 11 Drawing Sheets

U.S. PATENT DOCUMENTS

| | | | | |
|---|---|---|---|---|
| 4,745,515 | * | 5/1988 | Fowler | 361/185 |
| 4,791,394 | | 12/1988 | Mikulecky . | |
| 4,855,862 | | 8/1989 | Wainio et al. . | |
| 4,945,256 | | 7/1990 | Tada et al. . | |
| 5,008,516 | * | 4/1991 | Holling | 219/519 |
| 5,053,911 | * | 10/1991 | Kopec et al. | 361/154 |
| 5,055,962 | * | 10/1991 | Peterson et al. | 361/187 |
| 5,099,382 | | 3/1992 | Eppinger . | |
| 5,103,364 | | 4/1992 | Kamp . | |
| 5,128,825 | * | 7/1992 | Hurley et al. | 361/154 |
| 5,175,403 | | 12/1992 | Hamm et al. . | |
| 5,255,152 | * | 10/1993 | Estes, III et al. | 361/160 |
| 5,321,762 | | 6/1994 | Stuart . | |
| 5,361,184 | | 11/1994 | El-Sharkawi et al. . | |
| 5,539,608 | * | 7/1996 | Hurley et al. | 361/152 |
| 5,566,041 | | 10/1996 | Rumfield . | |
| 5,627,718 | | 5/1997 | Engel et al. . | |
| 5,638,296 | | 6/1997 | Johnson et al. | 364/492 |
| 5,652,691 | * | 7/1997 | Fowler | 361/155 |
| 5,673,165 | * | 9/1997 | Kuhn et al. | 361/154 |

OTHER PUBLICATIONS

European Search Report—May 19, 2000.

EP 96915870, Search Report (Feb. 24, 1999).

Request for Tender, Specification No. C54/92, entitled "12kV 3 phase pole mounted remotely controllable switchgear", closing date Jul. 22, 1992, issued and made available to the public in Australia by the South East Queensland Electricity Board (SEQEB) of 150 Charlotte Street, Brisbane Queensland 4000, as advertised in the Courier Mail newspaper on or about Wednesday Jun. 17, 1992 or Jun. 24, 1992.

"Technical Manual for N12, N24 and N36 Pole Mounted Circuited Breaker", Part No. N00–100, 1993 first published on or about Nov. 1993 by NU–LEC.

* cited by examiner

ELECTRICAL SWITCHGEAR WITH SYNCHRONOUS CONTROL SYSTEM AND ACTUATOR

CROSS-REFERENCE TO RELATED APPLICATIONS

The present application claims priority from U.S. patent application Ser. No. 08/945,384; which claims priority from International Patent Application Ser. No. PCT/US96/07114, filed on May 15, 1996; which is a continuation-in-part of U.S. patent application Ser. No. 08/440,783, filed on May 15, 1995, abandoned.

BACKGROUND OF THE INVENTION

1. Field of the Invention

The present invention relates to a method and a device for controlling electrical switchgear. More particularly, the invention relates to a method and a device that continuously and automatically optimizes switchgear performance.

2. Description of Related Art

In a power distribution system, switchgear are typically employed to protect the system against abnormal conditions. Abnormal conditions include, for example, power line fault conditions or irregular loading conditions. In general, switchgear are well-known in the art.

There are different types of switchgear for different applications. A fault interrupter is one type of switchgear. Fault interrupters are employed for automatically opening a power line upon the detection of a fault condition. Reclosers are another type of switchgear. In response to a fault condition, reclosers, unlike fault interrupters, rapidly trip open and then reclose the power line a number of times in accordance with a set of time-current curves. Then, after a pre-determined number of trip/reclose operations, the recloser will "lock-out" the power line if the fault condition has not been cleared. A breaker is a third type of switchgear. Breakers are similar to reclosers; however, they are generally capable of performing only an open-close-open sequence, and their interruption ratings are significantly higher than reclosers. A capacitor switch is a fourth type of switchgear. Capacitor switches are used for energizing and de-energizing capacitor banks. Capacitor banks are used for regulating the line current feeding large loads (e.g., industrial loads) when the load causes the line current to lag behind the line voltage. Upon activation, a capacitor bank pushes the line current back into phase with the line voltage, thereby boosting the power factor (i.e., the amount of power being delivered to the load). Capacitor switches generally perform one open or one close operation at a time.

As the switchgear contacts come into proximity with one another (i.e., during a closing operation) or when the contacts first separate (i.e., during an opening operation), some amount of arcing occurs between the contacts. Arcing can cause an excessive amount of heat to build up on the surface of the contacts, and accordingly, cause the contacts to wear-out at an excessively fast rate. Arcing can also strain or damage system components such as power transformers. Therefore, arcing is highly undesirable.

In general, all switchgear, irrespective of switchgear type, attempt to minimize arcing. Some switchgear designs attempt to accomplish this by driving the switchgear contacts apart (i.e., during an opening operation) or together (i.e., during a closing operation) as fast as possible. The theory behind this method is that if the amount of time the contacts spend in close proximity to one another is minimized, arcing is also minimized. In practice, this strategy is flawed, particularly during closing operations, because the contacts tend to bounce when they come into physical contact with each other as the relative velocity of the contacts increases. Contact bounce, in turn, leads to the generation of undesirable transient voltage and current events.

A more effective method for minimizing arcing and minimizing the generation of transients is to synchronize the initiation of the switchgear operation so that the actual closing or opening of the contacts occurs when the AC voltage or current across the contacts is at zero volts or zero amperes, respectively. For example, in FIG. 1, it is preferable that a closing of the contacts occurs when the AC voltage waveform 100 passes through a zero-voltage crossover point, such as point A. Generally, it is preferable to close at a voltage zero across the switchgear contacts and to open at a current zero to minimize arc time. Normal arc interruptions occur at a current zero. For a capacitor switch application, the capacitor load current leads the voltage by 90 electrical degrees. Therefore, the current waveform does not need to be monitored and it can be assumed that at a voltage zero the current is at a peak and at a current zero the voltage is at a peak. For true synchronous operations for other applications, both the voltage waveform and current waveform need to be monitored.

Present switchgear designs that employ a synchronizing method generally do so by pre-defining a fixed amount of time $t_1$, where $t_1$ is equal to a presumed AC voltage waveform period T less an amount of time $t_2$, wherein $t_2$, in turn, is an approximate amount of time required to complete the switchgear operation. For example, in FIG. 1, if the AC voltage waveform is operating at 60 Hz, the period T of the AC waveform 100 is 16.66 msec. If the pre-defined time $t_2$ is 11.66 msecs, then $t_1$ is 5 msecs. Accordingly, if a switchgear employing this method receives a command to initiate a close operation, the switchgear will detect a next zero-voltage crossover point, such as crossover point B in FIG. 1, then wait $t_1$ msecs, which corresponds with point C in FIG. 1, to initiate the switching operation. Likewise, if an open command is received, the switchgear will detect a next zero current crossover point and determine an appropriate opening point that is somewhat similar to the timing sequence described above for the closing operation. The opening point is determined such that at the next zero current crossover a sufficient contact opening gap is established that will interrupt the flow of current and withstand the power system recovery voltage to prevent reignitions or restrikes. From here on, the discussion will focus on synchronized voltage switching. However, it will be understood by one skilled in the art that switching could also be synchronized with the current waveform on opening.

Unfortunately, the fixed time synchronization method does not always produce accurate results. First, the AC voltage waveform 100 rarely propagates at exactly 60 Hz. In fact, it generally fluctuates slightly above and below 60 Hz. Accordingly, the period T of the AC voltage waveform 100 will fluctuate. Therefore, initiating a switching operation at point C does not always guarantee a synchronized opening or closing operation (i.e., an operation that is synchronized with a zero-voltage crossover point). Second, conditions such as ambient temperature can affect the dynamic friction of the mechanism and change the actual amount of time that it takes for the contacts to complete the switching operation. Therefore, the amount of time represented by $t_2$ may fluctuate with temperature. Thus, once again, initiating the switching operation at point C is not likely to consistently result in a synchronized opening or closing operation. Third, over the life of the switchgear, the distance the contacts must travel during a switching operation generally increases. This is due to ordinary contact wear and wear from the components of the mechanism. As the contact travel distance increases, it becomes less and less likely that initiating the switching operation at point C as a function $t_1$, $t_2$ and T will result in a synchronized switching operation.

In the particular case of a capacitor switch, minimizing arcing and minimizing the generation of transients is especially important. That is because even small inaccuracies in synchronizing a switching operation with a zero-voltage crossover point on the AC voltage waveform can result in arcing and/or transients that involve thousands of amperes and volts. Therefore, an enormous demand exists for a switchgear design, particularly a capacitor switch design, that provides more accurate, point-on-wave switching operation control, to better assure zero-voltage switching operations to minimize transient effects.

SUMMARY

The present invention provides precise, point-on-wave switching performance by employing a closed-loop feedback, microprocessor-based motion control design. By employing a closed-loop feedback, microprocessor-based design, the present invention can monitor and optimize switchgear contact motion (i.e., position and velocity) during a switching operation, thereby assuring a more accurate switching operation. Moreover, the closed-loop feedback design intrinsically compensates for the effects of such things as ambient temperature, AC waveform fluctuations, and changes in the physical condition of the switchgear. In addition, the present invention is capable of optimizing various motion control parameters both during and subsequent to a switching operation, to better assure that present and future operations are more accurately synchronized with the AC voltage or current waveform.

Accordingly, it is an object of the present invention to minimize arcing and transients during switching operations.

It is another object of the present invention to provide accurate, consistent point-on-wave switching.

It is another object of the present invention to continuously monitor and optimize, in real-time, the motion control system, based on present switching operation performance, to assure more consistent and accurate, point-on-wave switching.

It is still another object of the present invention to periodically optimize the motion control system, based on past switching operation performance, to assure more accurate, point-on-wave switching operations.

In accordance with one aspect of the present invention, these and other objects are achieved by a closed-loop feedback control system. The system includes a microprocessor; current generation means, operatively coupled to the microprocessor, for providing a driving current required to regulate an actuator for moving at least one of two switchgear contacts in the electrical switchgear; and position feedback means, operatively coupled to the at least one of two contacts, for providing contact position information to the microprocessor. The microprocessor, in turn, comprises means for controlling the current generation means in real-time, during a switching operation, as a function of an initial contact position and a present contact position, as provided by the position feedback means, such that the at least one contact transitions from the initial contact position to a final contact position in accordance with a pre-defined motion profile so as to provide AC waveform synchronized switching.

In accordance with another aspect of the present invention, these and other objects are achieved by a capacitor switch. The capacitor switch includes a current interrupter containing at least one moveable contact and an actuator coupled to the at least one moveable contact. The capacitor switch further includes a closed-loop feedback, motion control circuit comprising: a microprocessor, a pulse-width modulation (PWM) circuit operatively coupled to the microprocessor, and producing driving current for the actuator which is required to drive the at least one moveable contact from an initial contact position to a final contact position during a switching operation, a position sensor optically coupled to the at least one contact, and a decoder that receives and decodes contact position data from the position sensor and forwards the decoded contact position data to the microprocessor. The microprocessor includes closed-loop feedback means for controlling contact position and velocity in real time, during the switching operation, based on the initial contact position, a present contact position feedback signal and a present contact velocity feedback signal, such that the switching operation is synchronized with an AC voltage waveform across the capacitor switch.

In accordance with yet another aspect of the present invention, these and other objects are achieved by a closed-loop feedback method for controlling at least one contact in electrical switchgear during a switching operation. The method comprises the following steps: generating a driving current required to move the at least one contact; generating contact position feedback data in real-time, during the switching operation; and controlling the generation of driving current required to regulate the movement of the at least one contact in real-time, during the switching operation, as a function of an initial contact position and the real-time contact position feedback data, such that the at least one contact transitions from the initial contact position to a final contact position in accordance with a pre-defined motion profile so as to provide AC voltage or current waveform synchronized switching.

BRIEF DESCRIPTION OF THE DRAWINGS

In the text which follows, the invention is explained with reference to a number of figures in which.

DETAILED DESCRIPTION OF THE INVENTION

For a better understanding of the invention, reference may be made to the following detailed description taken in conjunction with the accompanying drawings, wherein preferred exemplary embodiments of the present invention are illustrated and described. The reference numbers are consistent throughout each of the drawings.

Figure 2:
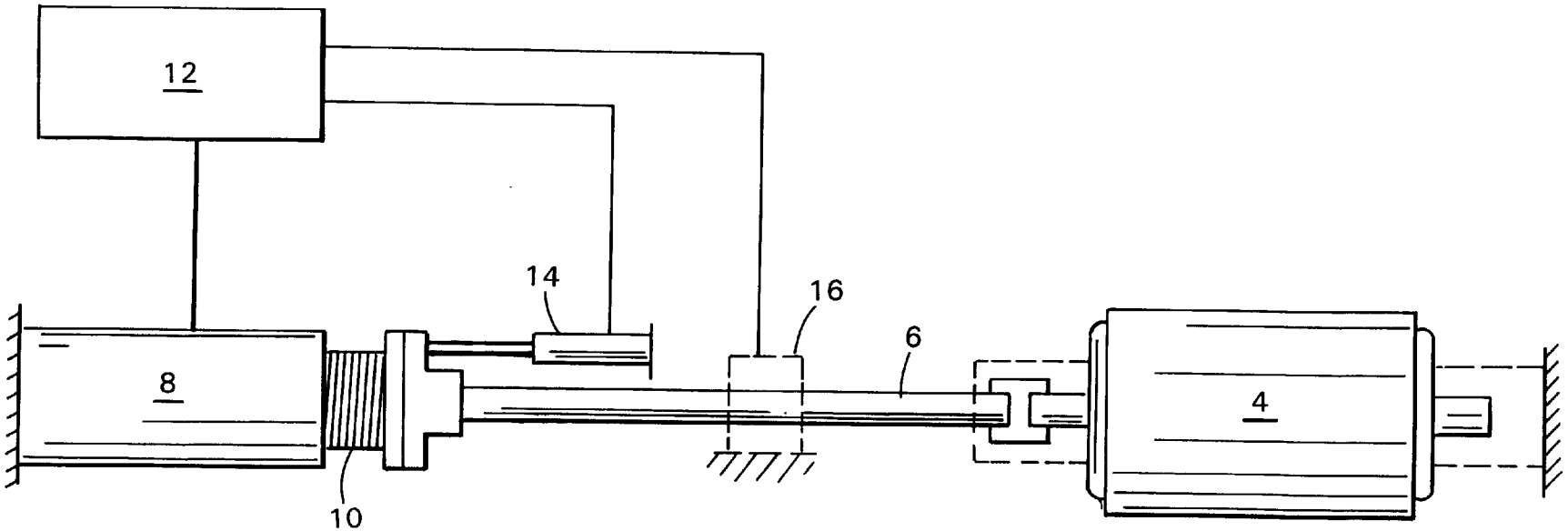
FIG. 2 is a schematic of a capacitor switch.

FIG. 2 is an exemplary schematic of a capacitor switch, although it will be understood that the schematic is consistent with other types of switchgear as well. As shown in FIG. 2, the capacitor switch includes a number of components including a voice coil actuator 8, a coil winding 10, a latching device 16, an operating rod 6, a current interrupter 4, a motion control circuit 12 and a position feedback device 14. Other fast actuators that could be utilized are linear motors and hydraulic mechanisms.

In general, the capacitor switch illustrated in FIG. 2 operates as follows. The voice coil actuator 8, which is a direct drive, limited motion device, uses a magnetic field produced by the coil winding 10 that reacts with the magnetic field in the gap of the magnetic structure to exert a force, that is proportional to the current flowing through the coil winding 10, on operating rod 6, which is operatively coupled to voice coil actuator 8. The force exerted on the operating rod 6 causes the operating rod 6 to move along its axis, either backward or forward, depending upon the direction of the current flow through the coil winding 10 to develop the force associated with an opening or a closing operation. The movement of the operating rod 6, in turn, causes a pair of switchgear contacts 71, 72, located in the current interrupter 4, as illustrated in FIG. 3, to either come together or to pull apart, again depending upon whether the switching operation is an opening or a closing operation.

Figure 3:
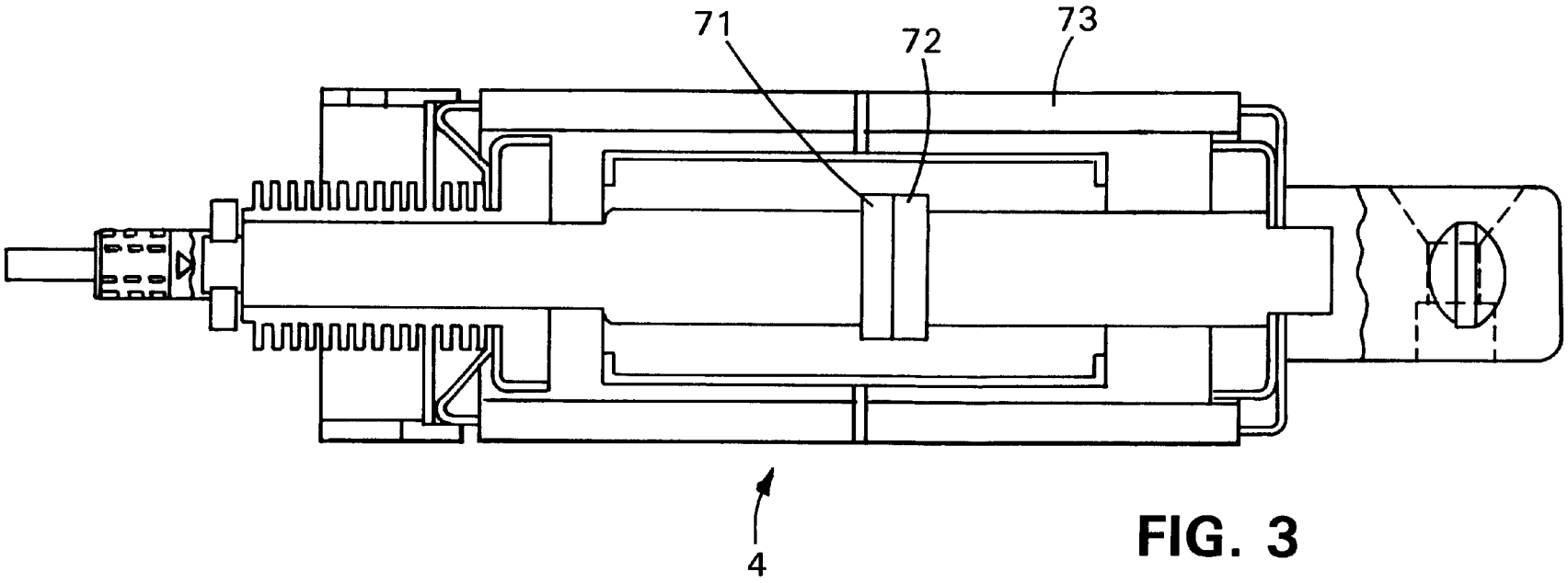
FIG. 3 is a cross-sectional view of a current interrupter.

As illustrated in FIG. 3, the switchgear contacts 71, 72 are essentially contained inside current interrupter 4. In accordance with a preferred embodiment, switchgear contact 71 is coupled to the operating rod 6. Accordingly, contact 71 moves axially as a function of the movement of operating rod 6. In contrast, switchgear contact 72 is fixed. When the contacts 71, 72 come together during a closing operation, AC circuit 2, shown in FIG. 2, is closed. When the contacts 71, 72 separate during an opening operation, AC circuit 2 is opened.

FIG. 3 shows current interrupter 4 in cross section. Current interrupter 4 includes a vacuum bottle, and disposed therein are the switchgear contacts 71, 72. The vacuum bottle provides a housing and an evacuated environment for the switchgear contacts 71,72. The vacuum bottle is usually constructed from an elongated, generally tubular, evacuated, ceramic casing 73, preferably formed from alumina. Although the preferred embodiment employs a vacuum module, one skilled in the art will understand that an interrupter containing a dielectric medium such as SF6, oil, air etc. may also be employed.

The current flowing through coil winding 10 is controlled by the motion control circuit 12. The motion control circuit 12 is connected to the position feedback device 14. The position feedback device 14 provides the motion control circuit 12 with real-time contact position feedback information during each switching operation, which the motion control circuit 12 can differentiate to obtain real-time contact velocity feedback information. The motion control circuit 12 uses the real-time position and velocity feedback information to achieve synchronized switching operations in accordance with a closed-loop feedback strategy, as will be described in greater detail below.

The motion control circuit 12 is also coupled to a latching device 16. When instructed by the motion control circuit 12, the latching device 16 holds the operating rod 6 in its current position. The latching device 16 may be a canted spring, a ball plunger, a magnetic-type latch, a bi-stable spring, a spring over-toggle or any other well-known equivalent latch. The latching device 16 must, however, provide enough contact pressure to minimize switchgear contact resistance, provide enough contact pressure to hold the contacts together during rated, momentary currents, and it must exhibit a break force greater than the contact pressure.

Figure 4:
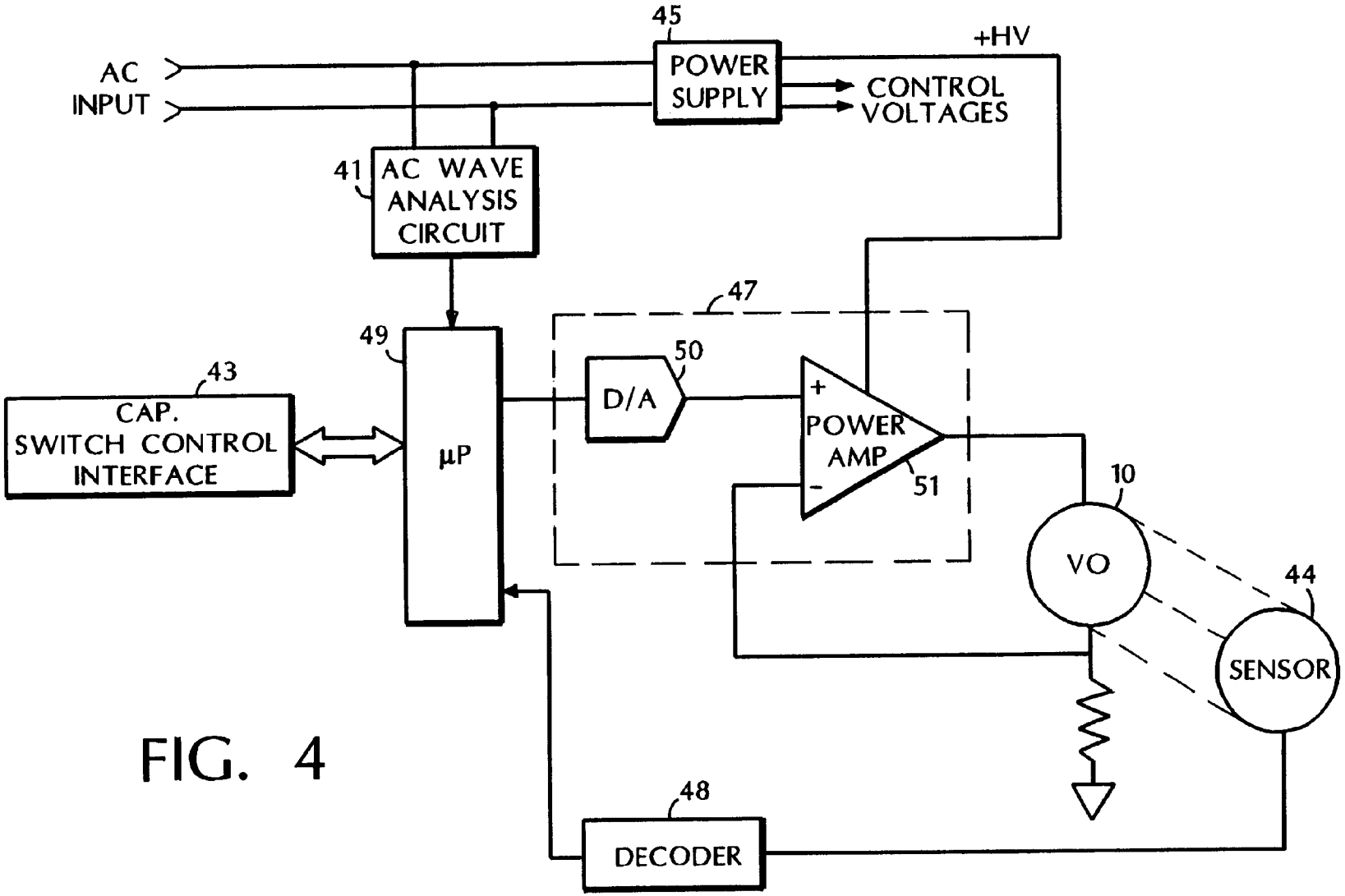
FIG. 4 is a schematic of a motion control circuit.

The motion control circuit 12 is illustrated in greater detail in FIG. 4. As shown, the motion control circuit 12 includes an AC waveform analysis circuit 41, a capacitor switch control interface 43, a power supply 45, a pulse width modulation unit (PWM) 47, a decoder 48 and a microprocessor 49.

The power supply 45 provides a number of voltage levels for the motion control circuit 12. First, it supplies a voltage level +HV which powers the amplifier in the PWM unit 47. The amplifier in the PWM unit 47, in turn, powers the voice coil actuator 8 via a MOSFET bridge (not shown in FIG. 4). The power supply 45 also provides a number of control voltages, such as a 15 VDC and a 5 VDC for the low power electronic devices.

The AC voltage waveform analysis circuit 41 provides timing information that relates to the zero-voltage crossover points along the AC voltage waveform. The AC voltage waveform analysis circuit 41 derives this information from the incoming AC voltage input to the power supply 45. In a preferred embodiment, the AC voltage waveform analysis circuit 41 generates a pulse coincident to the occurrence of each zero-voltage crossover point. Each pulse is transmitted to the microprocessor 49, wherein the switching operation control algorithm described below uses each pulse to generate different interrupt signals. The interrupt signals are crucial for ensuring synchronized switching operations. These interrupt signals will also be discussed in greater detail below. In a preferred embodiment, the AC voltage waveform analysis circuit 41 may include a waveform analyzer, a phase-lock loop and a zero-voltage detection circuit.

The switching operation execute command signals that instruct the capacitor switch to open or close are typically generated by a capacitor bank control system (not shown). However, it will be understood that the switching operation execute commands could be manually generated. The switching operation execute commands are fed to the microprocessor 49 on optically isolated input lines, through the industry standard capacitor switch control interface 43. The capacitor switch control interface 43 is generally a 5 pin connector which provides the open command signal on a first pin, the close command signal on a second pin, a ground on a third pin and a two-line 120VAC power input on a fourth and fifth pin.

The PWM unit 47 is located between the microprocessor 49 and the voice coil winding 10. During a switching operation, the PWM unit 47 continuously receives digital, current control signals from the microprocessor 49. In response, the PWM unit 47 generates a current which flows through the voice coil winding 10. The current flowing through the voice coil winding that reacts with the magnetic field formed in the gap of the magnetic structure, in the case of the voice coil 10, in turn, controls the strength of the magnetic field which generates a force from the voice coil actuator 8. In this manner, the microprocessor 49 controls the relative position and velocity of the switchgear contact 71 during each switching operation. In a preferred embodiment, the PWM unit 47 comprises a digital-to-analog converter 50 and a bi-polar, power amplifier 51.

The microprocessor 49 is, of course, at the heart of the motion control circuit 12. Particularly, the microprocessor 49 uses the information which it receives from the capacitor switch control interface 43, the AC voltage waveform analysis circuit 41, and the position feedback device 14 to execute a switching operation control algorithm. The switching operation control algorithm is used by the microprocessor 49 to optimize switching operation performance by ensuring AC voltage waveform synchronization.

To close the motion control feedback loop, switchgear contact position information must be fed back to the microprocessor 12. This is the function of the position feedback device 14. The position feedback device 14 includes an encoder 44 and a decoder 48. Although the encoder could be implemented using any number of linear devices, for example, a linear potentiometer, LVDT, a linear tachometer, etc. such devices are prone to noise. Accordingly, an optical quadrature encoder is used in a preferred embodiment of the present invention.

The position feedback device 14 actually performs two primary functions. First, the position feedback device 14 continuously samples the position of the movable contact 71 during a switching operation, for example, every 250 $\mu$secs. The position information is then encoded by the optical encoder 44, which feeds the information to decoder 48. Decoder 48 then digitizes the position data and forwards it to the microprocessor 49. The microprocessor 49, and more specifically, the switching operation control algorithm executed by the microprocessor 49, then uses the information to continuously optimize the relative position and velocity of the switchgear contacts 71, 72 during a switching operation. Second, the position feedback device 14 provides the switching operation control algorithm with information relating to the total distance traveled by the movable contact 71 during the previous switching operation. This information is used by the switching operation control algorithm to establish an initial contact position at the beginning of each switching operation.

The switching operation control algorithm executed by the microprocessor 49 performs the essential operations necessary to provide AC voltage waveform synchronized switching, also referred to as point-on-wave switching. The switching operation control algorithm is implemented in software. The software may be stored in a memory resident on the microprocessor 49, or in a separate memory device.

In general, the switching operation control algorithm ensures AC voltage waveform synchronized switching by i) establishing an optimal switching operation initiation time, based on data received from the AC voltage waveform analysis circuit 41, following the receipt of the switching operation execute command; ii) monitoring the capacitor switch control interface 43 for a switching operation execute command (i.e., an open or close command); iii) establishing an initial contact position; iv) initiating the switching operation at the optimal switching operation initiation time; and v) driving the contact 71 from the initial contact position to an ending contact position in accordance with a preprogrammed motion profile. These functions will now be described in greater detail.

Figure 1:
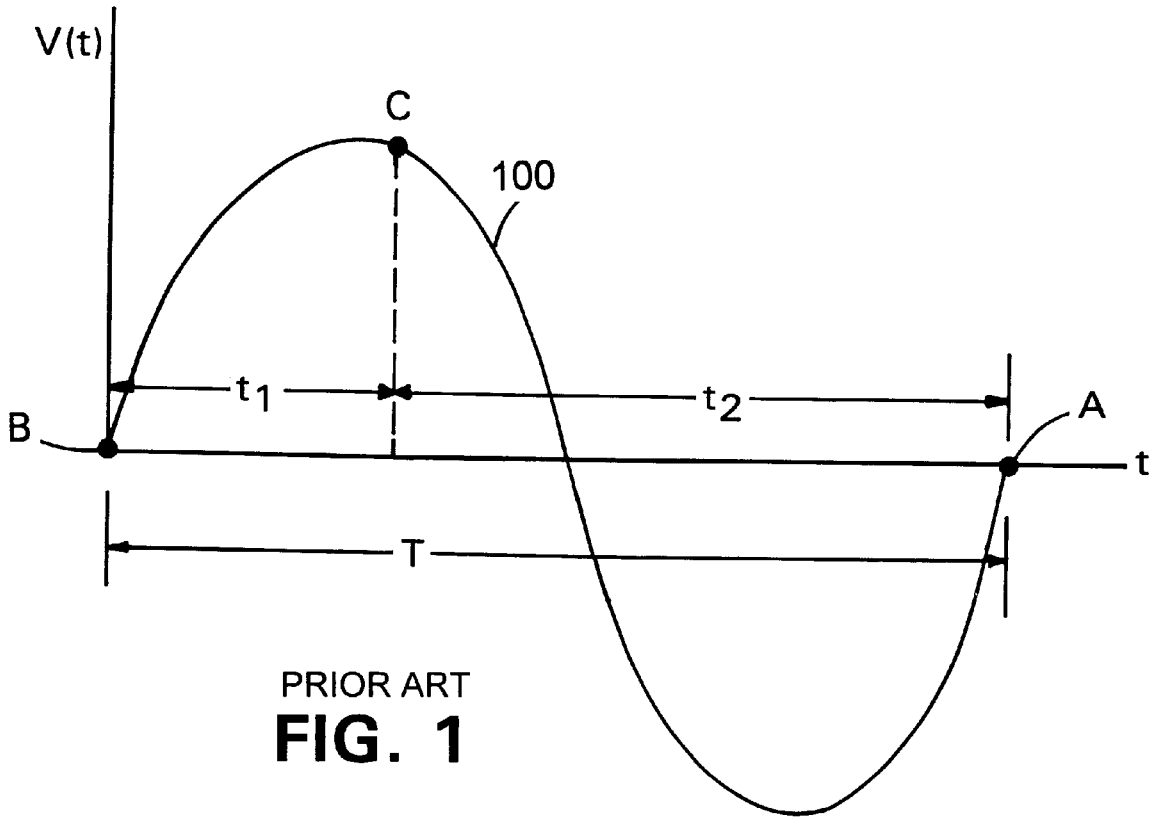
PRIOR ART FIG. 1
FIG. 1 is a graph illustrating an AC voltage or current waveform.

First, the switching operation control algorithm determines when the switching operation is to be initiated, following a switching operation execute command, in order to achieve AC voltage waveform synchronized switching. To accomplish this, the switching operation control algorithm relies on zero-voltage crossover timing information that takes the form of a sequence of timing pulses, wherein each timing pulse corresponds to the occurrence of a zero-voltage crossover point (e.g., point B in FIG. 1). As stated above, the pulses are generated by the AC voltage waveform analysis circuit 41.

More specifically, the switching operation control algorithm uses the timing pulses to generate at least two different types of interrupt signals. The first of these at least two interrupt signals is a zero-voltage crossover interrupt signal $V_{INT}$. A $V_{INT}$ interrupt signal is generated each time the microprocessor 49 receives a timing pulse from the AC voltage waveform analysis circuit 41. Hence, a $V_{INT}$ interrupt signal is simultaneously generated each time the AC waveform passes through a zero-voltage crossover point. Accordingly, if the AC voltage waveform is oscillating at exactly 60 cycles/second, a $V_{INT}$ interrupt signal is generated every 8.33 msecs.

The second type of interrupt signal generated by the switching operation control algorithm is the time interval $T_{INT}$ interrupt signal. In accordance with a preferred embodiment of the present invention, 32 $T_{INT}$ signals, corresponding to 32 time intervals of equal length, are generated during each half-cycle of the AC voltage waveform. By counting each $T_{INT}$ interrupt signal generated since the last $V_{INT}$ interrupt signal, the switching operation control algorithm is able to determine exactly where it is along the AC voltage waveform. Moreover, if the switching operation control algorithm is able to determine how many $T_{INT}$ interrupt signals have been generated since the last $V_{INT}$ interrupt signal (i.e., since the last zero-voltage crossover point), the switching operation control algorithm is able to determine how many additional $T_{INT}$ interrupt signals are to be generated before the next $V_{INT}$ interrupt signal (i.e., before the next zero-voltage crossover point).

In accordance with a preferred embodiment of the present invention, the switching operation control algorithm determines the optimal switching operation initiation time as a function of the number of $T_{INT}$ intervals required to complete the switching operation. The number of $T_{INT}$ intervals required to complete the switching operation, in turn, is determined based on the distance that the movable contact 71 will travel and the velocity at which the moveable contact 71 will travel during the switching operation, wherein the velocity of the moveable contact 71 throughout the switching operation is defined by a desired motion profile.

Figure 7:
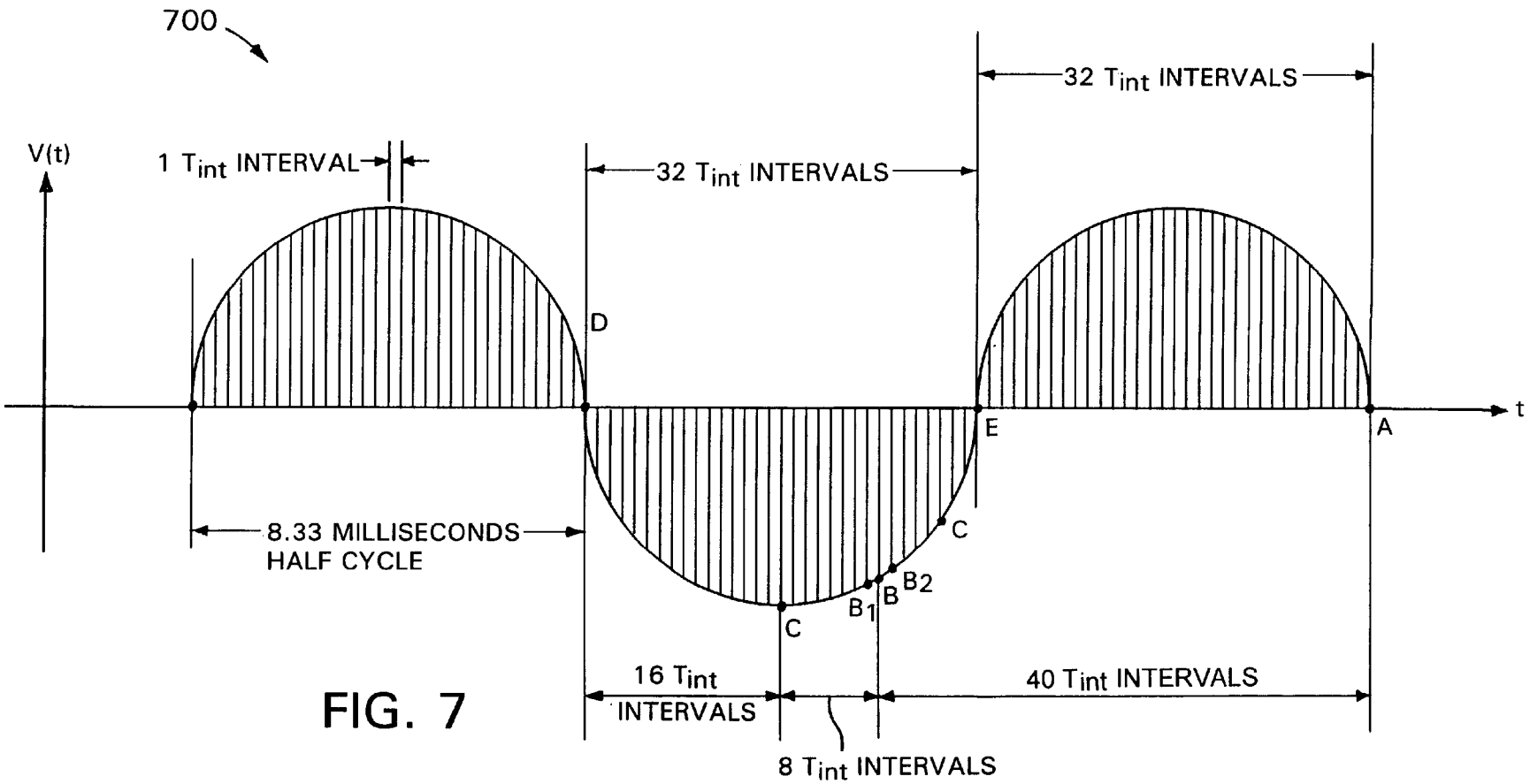
FIG. 7 is a graph illustrating an AC voltage waveform.

FIG. 7 shows an exemplary AC voltage waveform 700, wherein each half-cycle of the AC voltage waveform 700 is divided into 32 equally spaced $T_{INT}$ intervals. If, for example, 40 $T_{INT}$ intervals are required to complete the switching operation, the switching operation control algorithm knows that it must initiate the switching operation no later than point B along the AC voltage waveform 700, if the switching operation control algorithm is to achieve AC voltage waveform synchronized switching at point A, wherein 24 $T_{INT}$ intervals separate point D and point B, and 40 $T_{INT}$ intervals separate point B and point A. Accordingly, if the switching operation control algorithm receives a switching operation execute command at point C, wherein 16 $T_{INT}$ intervals separate point D and point C, the switching operation control algorithm knows that it must wait until it receives exactly 8 additional $T_{INT}$ interrupt signals before initiating the switching operation at point B.

To ensure optimal switching performance on a continuing basis, the switching operation control algorithm must be able to adjust for any change in the amount of time (i.e., for any change in the number of $T_{INT}$ intervals) required to complete a switching operation. In the previous example, it was stipulated that 40 $T_{INT}$ intervals were required to complete the switching operation. Over the life of the capacitor switch, the number of $T_{INT}$ intervals required to complete an AC voltage waveform synchronized switching operation is not likely to change, and if it does change, it is not likely to change significantly. However, the present invention tracks the performance of each switching operation, and in doing so, it determines if and when the switching operations become asynchronous. If, for example, the switching operations are consistently overshooting the intended zero-voltage crossover point, the switching operation control algorithm can adjust itself so that it begins initiating the switching operations earlier than before by an appropriate number of $T_{INT}$ intervals (e.g., at point $B_1$ in FIG. 7 rather than point B). If, for example, the switching operations are consistently undershooting the intended zero-voltage crossover point, the switching operation control algorithm can adjust itself so that it begins initiating switching operations later than before by an appropriate number of $T_{INT}$ intervals (e.g., at point $B_2$ in FIG. 7 rather than point B).

If, in the example illustrated in FIG. 7, the switching operation control algorithm receives a switching operation execute command at point $C_1$ rather than at point C, the switching operation control algorithm knows that there is an insufficient period of time to achieve AC voltage synchronized switching at point A. Accordingly, the switching operation control algorithm will continue to track the $T_{INT}$ interrupt signals and initiate the switching operation 24 $T_{INT}$ interrupt signals after receiving the next $V_{INT}$ interrupt signal (i.e., the $V_{INT}$ interrupt signal associated with the next zero-voltage crossover point, which corresponds to point E in FIG. 7), thereby achieving AC voltage waveform synchronized switching at the zero-voltage crossover point following point A (not shown in FIG. 7).

At the onset of each switching operation, the switching operation control algorithm establishes an initial contact position. As explained above, the initial contact position represents the distance that the movable contact 71 is expected to travel during the present switching operation. In accordance with a preferred embodiment of the present invention the switching operation control algorithm establishes this initial contact position as the actual distance traveled by the movable contact 71 during the previous switching operation. Of course, the switching operation control algorithm obtains the actual distance traveled by the movable contact 71 through the position feedback device 14.

It was also explained above that the distance which the moveable contact 71 must travel to complete a switching operation may gradually increase over the life of the capacitor switch, due to contact wear, mechanism wear, and seasonal changes due to temperature effects. However, it will be understood that from one switching operation to the next, any increase is expected to be small. Therefore, by setting the initial contact position equal to the distance traveled by the moveable contact 71 during the previous switching operation, the switching operation control algorithm accounts for incremental changes that occur over the life of the capacitor switch, which in turn, allows the switching operation control algorithm to continuously optimize switching operation performance.

For example, if the moveable contact 71 traveled a total distance of 100 units during the previous switching operation, the switching operation control algorithm, at the onset of the present switching operation, sets the initial contact position to 100 units. As will be explained in greater detail below, the switching operation control algorithm actually treats the initial contact position as a position error, which must be reduced to zero precisely at the intended zero-voltage crossover point.

Once a switching operation has been initiated, the switching operation control algorithm continuously regulates the amount of current flowing into the voice coil winding 10. This, in turn, controls the amount of force driving the moveable contact 71 from its initial position to its ending position. In a preferred embodiment, the switching operation control algorithm regulates the current by executing the closed-loop, position feedback process shown in FIG. 6.

Figure 6:
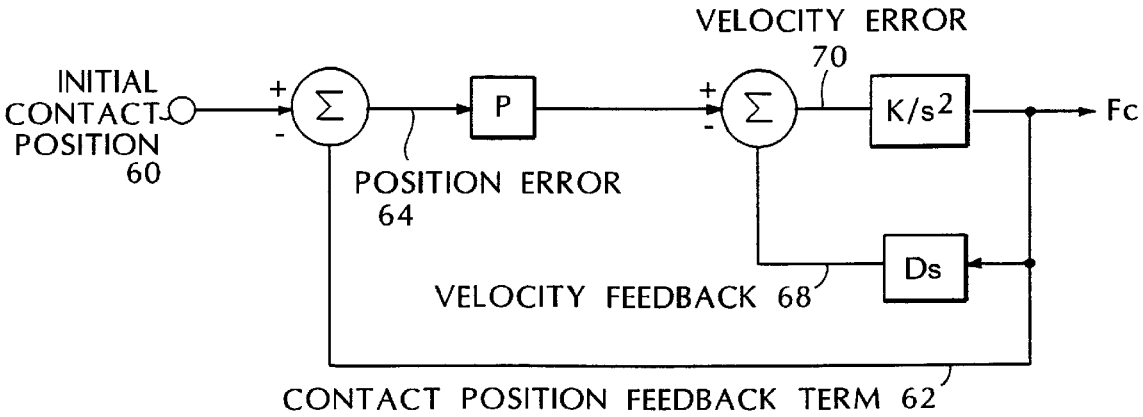
FIG. 6 illustrates a closed-loop feedback process in accordance with another embodiment of the present invention.

In accordance with the closed-loop position feedback process shown in FIG. 6, the value associated with the initial contact position (60) is loaded into the process as shown. As stated above, the initial contact position represents the distance which the moveable contact 71 is expected to travel during the present switching operation, and it equals the actual distance traveled by the moveable contact 71 during the previous switching operation. During the present switching operation, the value associated with the initial contact position (60) is continuously compared in real-time with the contact position feedback term (62), which is fed back into the switching operation control algorithm by the position feedback device 14. This comparison produces a position error (64). The position error (64) represents the distance which the moveable contact 71 still must travel to complete the switching operation. Accordingly, it is the position error (64) which the switching operation control algorithm is attempting to drive to zero precisely at the intended zero-voltage crossover point. The position error (64) is then multiplied by a scaling constant P, which is then compared with the velocity feedback term (68). The switching operation control algorithm derives the velocity feedback term (68) by differentiating the contact position feedback term (62). The second comparison results in a velocity error (70). The velocity error (70) is then used by the switching operation control algorithm to increase the amount of current to the voice coil winding 10 or decrease the amount of current to the voice coil winding 10, which ever is appropriate, in order to follow the desired motion profile. The transfer function associated with the process depicted in FIG. 6 is as follows.

$$((s)/R(s)=(KP^2)/(s^2+KD_s+KP^2) \quad (1)$$

Figure 8A:
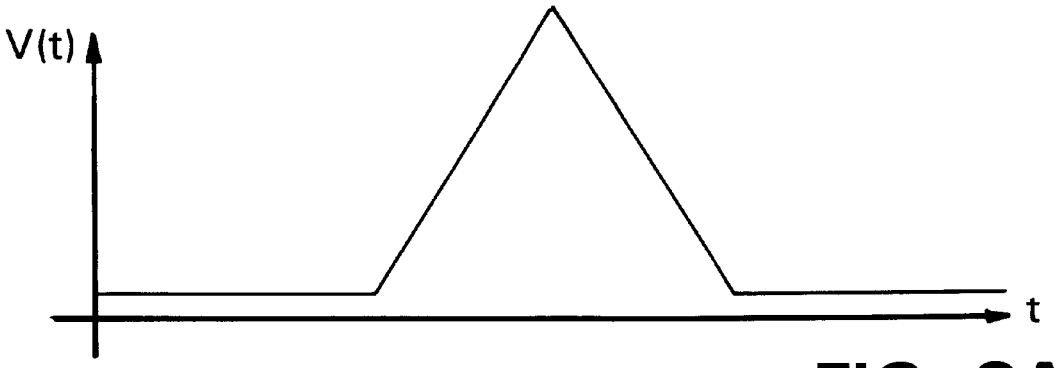
FIGS. 8A–8C illustrate exemplary motion profiles.

FIG. 8A depicts an exemplary motion profile. As stated above, a motion profile defines the velocities at which the moveable contact 71 should be traveling over the duration of a switching operation in order to achieve AC voltage waveform synchronized switching. The motion profile is, in turn, defined by the process transfer function, for example, the process transfer function of equation (1). By adjusting the transfer function values P and/or D in equation (1), the exemplary motion profiles illustrated in FIGS. 8B and 8C may be achieved, in lieu of the motion profile illustrated in FIG. 8A.

By accomplishing each of the above-identified functions, the switching operation control algorithm is able to optimize switching operation performance in a number of ways. First, the switching operation control algorithm inherently optimizes switching operation performance by virtue of the position feedback process itself. That is because position and velocity information are fed back to the switching operation control algorithm in real-time (e.g., every 250 $\mu$secs) during the switching operation. The switching operation control algorithm then uses the information to continuously correct (i.e., increase or decrease) the amount of current controlling the force applied to the moveable contact 71, thereby ensuring AC voltage waveform synchronized switching. Second, if there is excessive position error (e.g., the moveable contact 71 is not accelerating rapidly enough to achieve the motion profile by a significant amount), the switching operation control algorithm is capable of adjusting certain transfer function parameters during the switching operation to preserve AC voltage waveform synchronized switching. For example, if the position error signal is excessively large, the switching operation control algorithm can adjust the value of D appropriately. If, however, the velocity error is excessively large, the switching operation control algorithm can adjust the value of P. Third, in addition to adjusting the transfer function parameters in real-time, the switching operation control algorithm is capable of storing performance data from a previous switching operation (e.g., position and velocity values) and then comparing the prior performance data to corresponding points along the desired motion profile. The difference between the stored values and the motion profile values can then be used to determine whether it is necessary to further adjust the transfer function parameters, that is, the values of P and D, or the ratio of P to D, in order to assure AC voltage waveform synchronized switching for subsequent switching operations.

Figure 5:
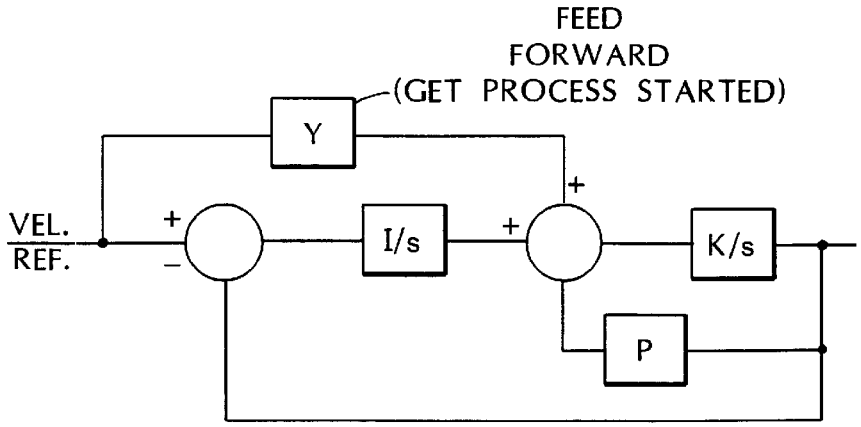
FIG. 5 illustrates a closed-loop feedback process in accordance with one embodiment of the present invention.
Figure 8B:
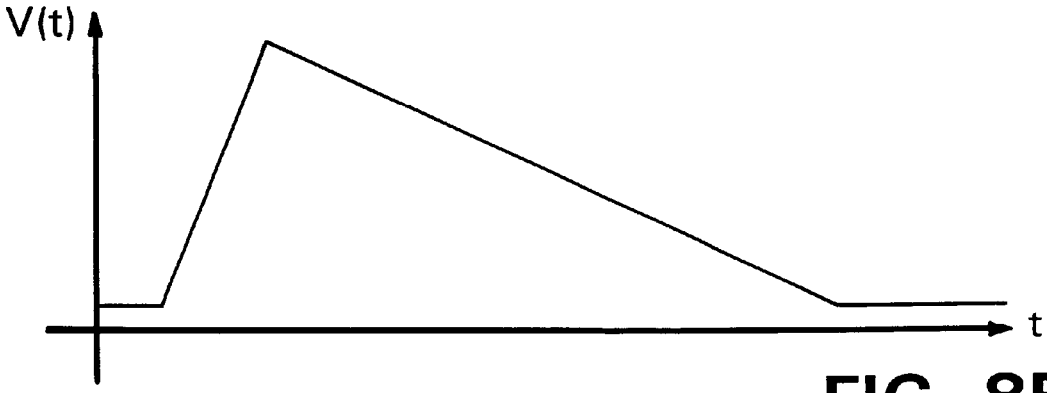
Figure 8C:
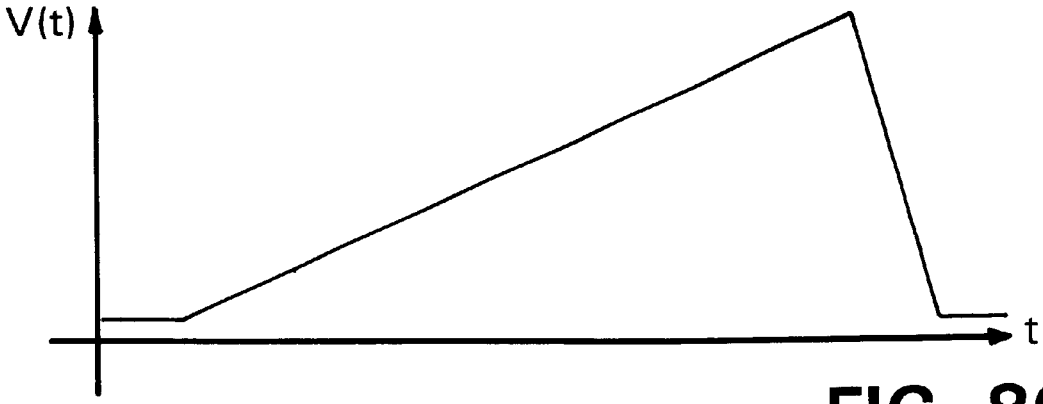
Figure 9:
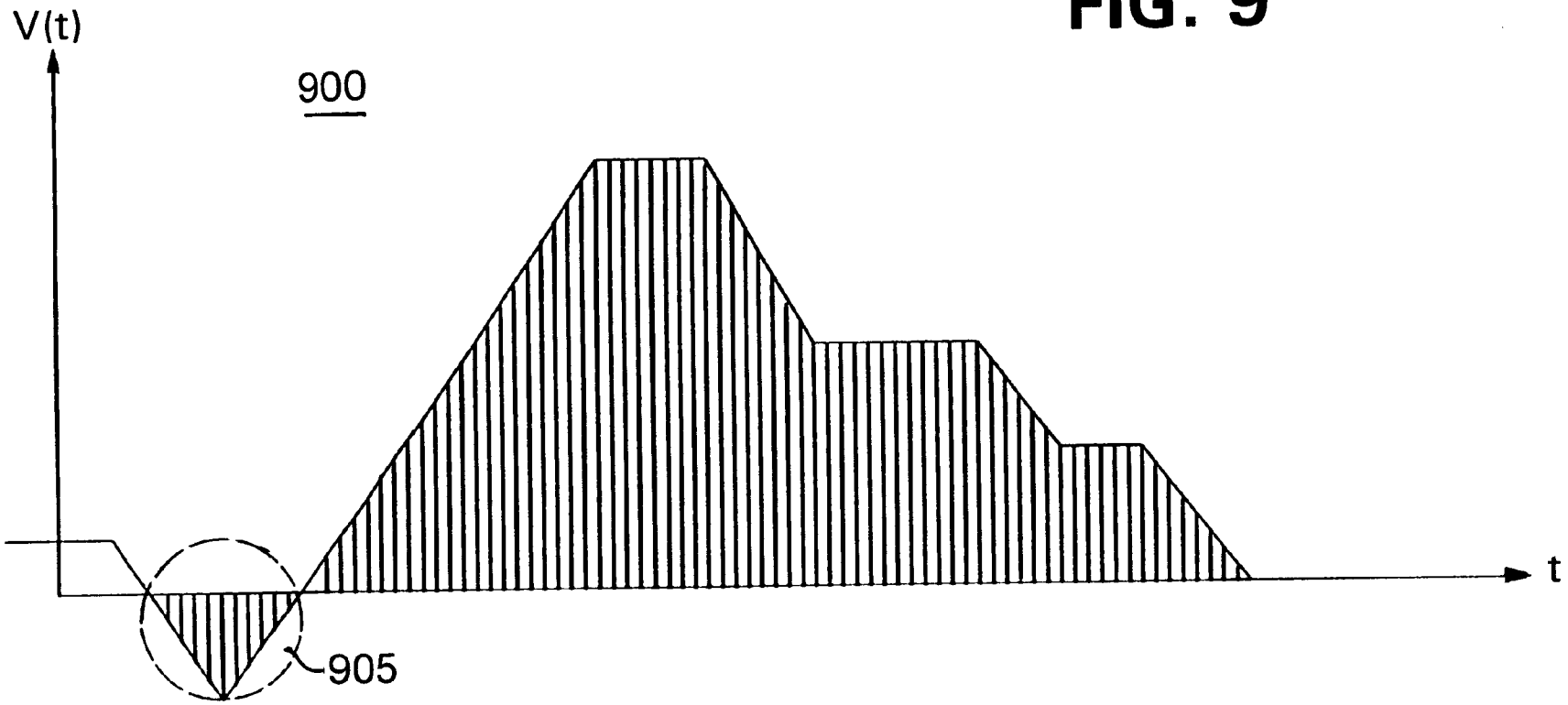
FIG. 9 illustrates a complex exemplary motion profile.

While the closed-loop position feedback process illustrated in FIG. 6 has a transfer function that defines somewhat simple, trapezoidal motion profiles, such as those illustrated in FIGS. 8A–8C, other closed-loop processes could be employed to define more complex motion profiles as required. For example referring to FIG. 9, during a recloser opening operation, it is sometimes necessary to provide a negative force to break the weld that forms between the contacts before driving the contacts apart, as exemplified by profile segment 905. Therefore, in an alternative embodiment, the switching operation control algorithm may reference a look-up table to retrieve discrete velocity values during the course of the switching operation. In doing so, it is more feasible to achieve a complex motion profile, such as the motion profile 900 illustrated in FIG. 9. FIG. 5 shows an exemplary closed-loop process for accomplishing such a complex motion profile; wherein the process illustrated in FIG. 5 includes both a feedback and a feed-forward path.

In a preferred embodiment of the present invention, the switch operation control algorithm comprises a number of different routines, each implemented in software using standard programming techniques. Exemplary embodiments for these routines are illustrated in the flowcharts of FIGS. 10A–C.

Figure 10A:
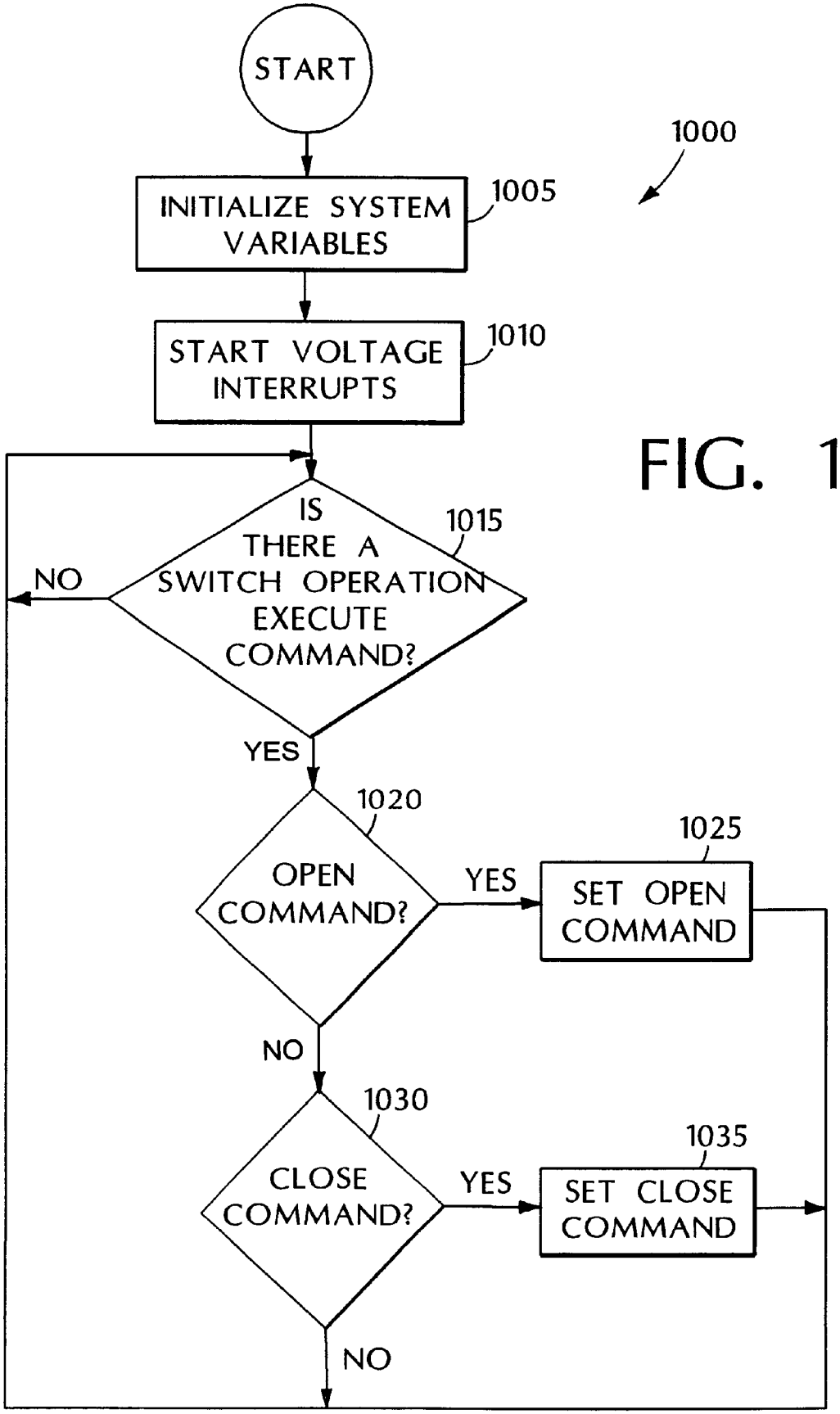
FIGS. 10A–10C illustrate a particular technique for implementing the switching operation control algorithm.

First, FIG. 10A illustrates a main start-up and initialization routine 1000. Routine 1000 begins by initializing a number of system variables, as shown in step 1005. The routine then enables the generation of $V_{INT}$ interrupt signals, in accordance with step 1010. As explained previously, the $V_{INT}$ interrupt signals are generated as a function of the zero-voltage crossover timing pulses, which are produced by the AC voltage waveform analysis circuit 41.

After enabling the $V_{INT}$ interrupt signals, the main start-up and initialization routine 1000 determines whether a switching operation execute command has been received, for example, through the capacitor switch control interface 43, in accordance with decision step 1015. If it is determined that no switching operation execute command has been received, in accordance with the "NO" path out of decision step 1015, the main start-up and initialization routine 1000 remains in a loop, whereby it continues to check for the presence of a switching operation execute command. If, however, it is determined that a switching operation execute command has been received, in accordance with the "YES" path out of decision step 1015, it is further determined whether the switching operation execute command is an OPEN switch command, as illustrated by decision step 1020. If the switching operation execute command is an OPEN switch command, in accordance with the "YES" path out of decision step 1020, the appropriate switching operation status flag(s) are set to reflect the presence of an OPEN switch command. If the switching operation execute command is not an OPEN switch command, in accordance with the "NO" path out of decision step 1020, the main start-up and initialization routine 1000 determines whether the switching operation execute command is a CLOSE switch command, in accordance with decision step 1030. If it is determined that the switching operation execute command is a CLOSE switch command, in accordance with the "YES" path out of decision step 1030, the appropriate switching operation status flags(s) are set to reflect the presence of a CLOSE switch command. However, if it is determined that neither an OPEN switch command nor a CLOSE switch command are present, the main start-up and initialization routine 1000 returns to the decision loop associated with decision step 1015, whereby it continues to look for switching operation execute commands. The switching operation status flag(s) indicating the presence of an OPEN switch command or the presence of a CLOSE switch command, set during steps 1025 or 1035 respectively, are employed later by the timed interval $T_{INT}$ routine to invoke the motion control routine, as described in greater detail below.

Figure 10B:
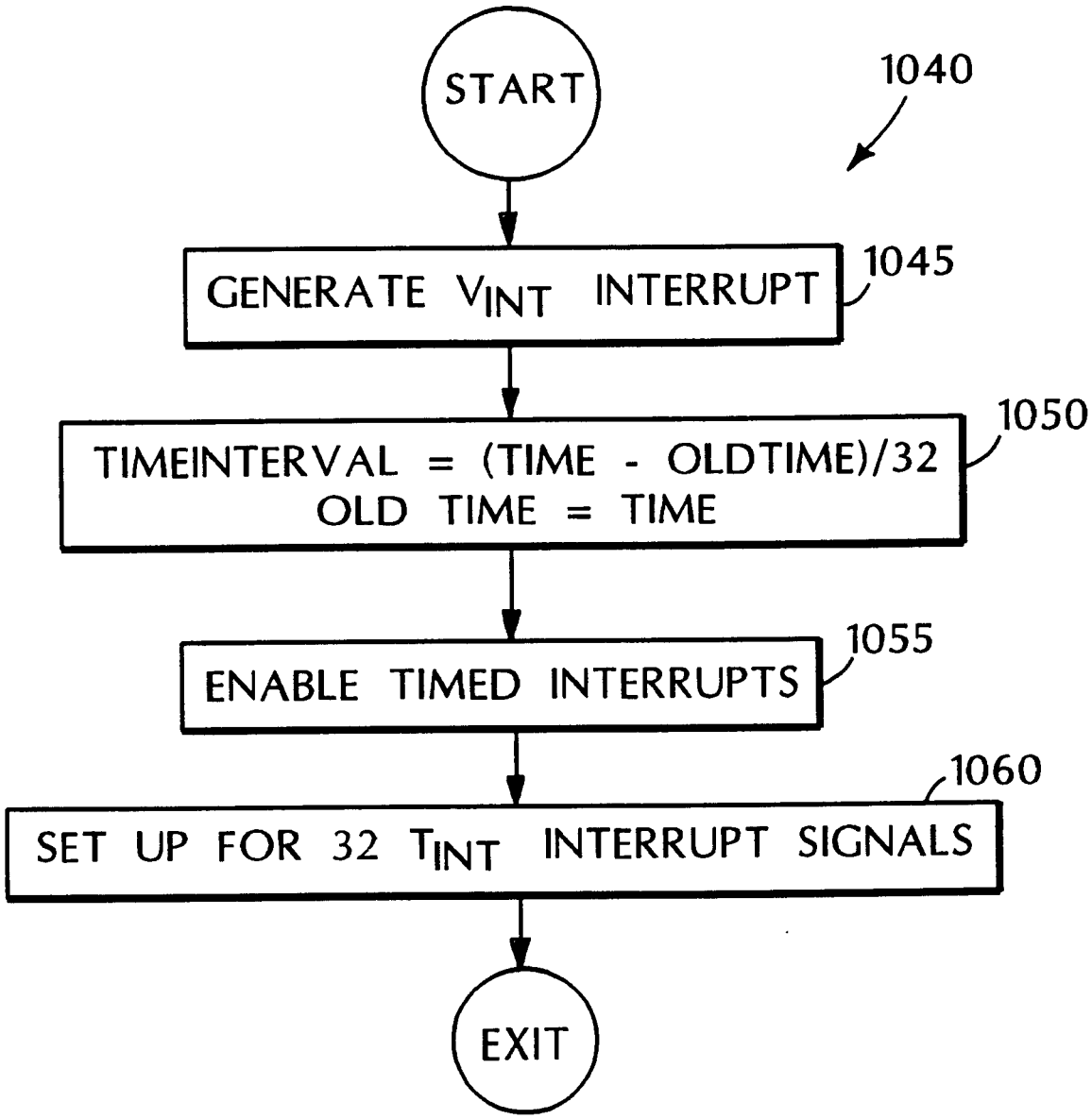
Figure 10C:
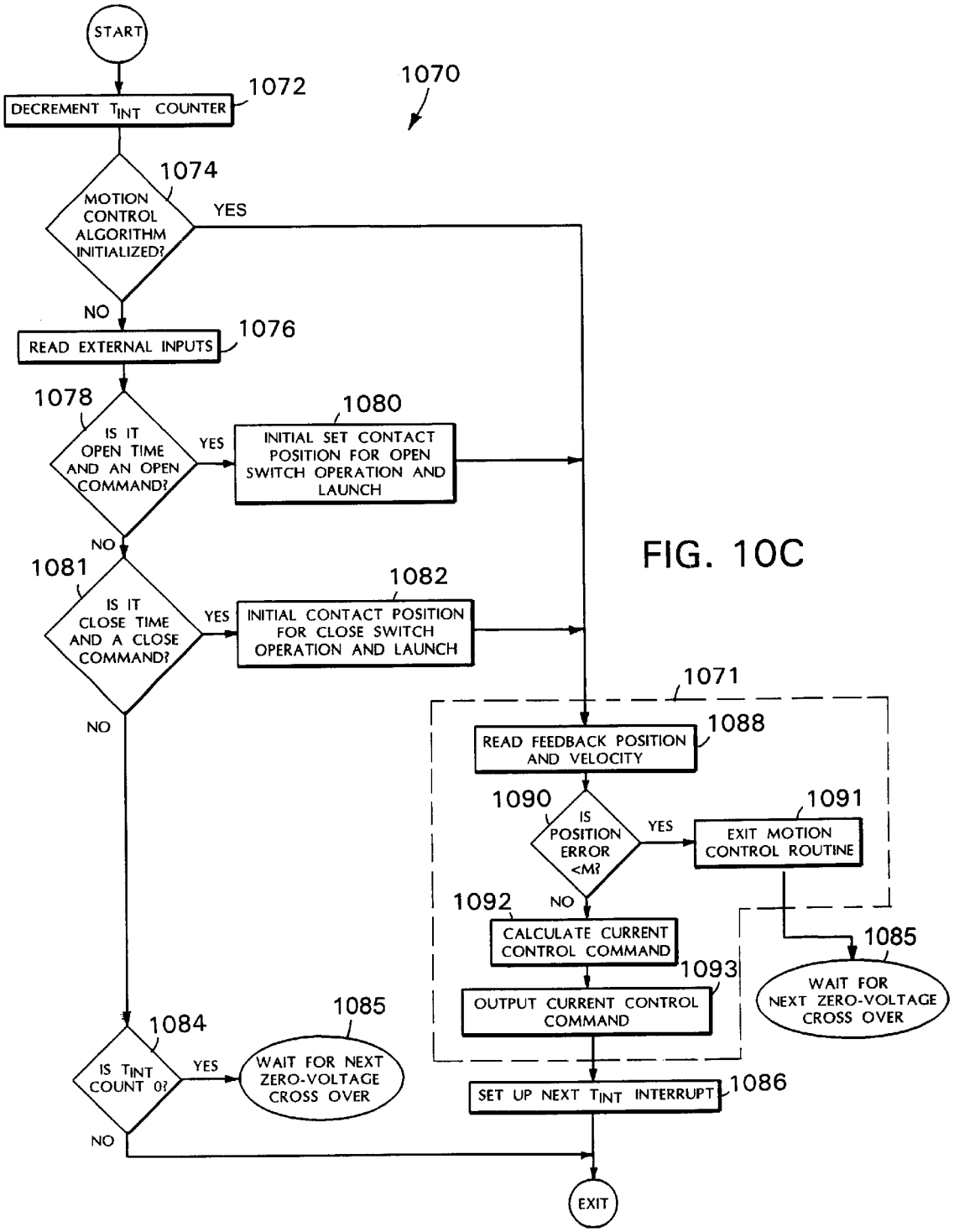

Upon enabling the $V_{INT}$ interrupt signals, in accordance with step 1010, the microprocessor 49 begins executing a zero-voltage interrupt routine 1040, as illustrated in FIG. 10B. The zero-voltage interrupt routine 1040 begins by generating a $V_{INT}$ interrupt signal, in accordance with step 1045, upon the microprocessor 49 receiving a zero-voltage crossover timing pulse from the AC voltage waveform analysis circuit 41. The clock time corresponding to the generation of the $V_{INT}$ interrupt signal is then stored as the system variable TIME. Then, in accordance with step 1050, the zero-voltage interrupt routine 1040 determines the amount of time associated with the variable TIMEINTERVAL, wherein the variable TIMEINTERVAL represents the length of time associated with the $T_{INT}$ intervals which separate each of the 32 $T_{INT}$ interrupt signals to be generated during the present half-cycle of the AC voltage waveform. In a preferred embodiment, the variable TIMEINTERVAL is determined by the difference between the variable TIME, which represents the time of occurrence of the present zero-voltage crossover point, and a variable OLDTIME, which represents the time of occurrence of the previous zero-voltage crossover point. As one skilled in the art will readily appreciate, the difference between the variable TIME and the variable OLDTIME reflects the present half-cycle of the AC voltage waveform. The variable TIMEINTERVAL is then divided by 32, as each half-cycle of the AC voltage waveform is divided into 32 equally spaced intervals, during which a single $T_{INT}$ interrupt signal is generated, as explained above. The zero-voltage interrupt routine 1040 then enables the generation of $T_{INT}$ interrupt signals, in accordance with step 1055. This involves loading an internal counter, referred to herein below as the timed interval counter, with the value associated with the variable TIMEINTERVAL. The timed interval counter immediately begins decrementing from the value associated with the variable TIMEINTERVAL. Each time the timed interval counter cycles around to zero, a $T_{INT}$ interrupt signal is generated. In accordance with step 1060, a second counter, herein referred to as the $T_{INT}$ counter, is loaded with the value 32. Each time a $T_{INT}$ interrupt signal is generated, the $T_{INT}$ counter is decremented by one. The purpose of the $T_{INT}$ counter will become more apparent from the description of the $T_{INT}$ interrupt routine below.

The $T_{INT}$ interrupt routine 1070, and the motion control routine 1071 are illustrated in FIG. 10C. When the timed interval counter decrements to zero, a $T_{INT}$ interrupt signal is generated. This, in turn, causes the $T_{INT}$ counter to be decremented by one, as shown in step 1072. By decrementing the $T_{INT}$ counter, the present position along the AC voltage waveform is precisely tracked.

The $T_{INT}$ interrupt routine 1070 then checks a motion control status flag to determine whether the motion control routine has been launched. Initially, the motion control routine status flag is reset, in accordance with the "NO" path out of decision block 1074, indicating that the motion control routine 1071 has not been launched. The $T_{INT}$ interrupt routine 1070 then checks the state of the aforementioned switching operation status flag(s), in accordance with step 1076, to determine whether an OPEN switch command or a CLOSE switch command is present. The state of the switching operation status flag(s) is set, if at all, by the main start-up and initialization routine 1000, steps 1020–1035, as shown in FIG. 10A.

The $T_{INT}$ interrupt routine 1070 then determines whether the switching operation status flag(s) indicate the presence of an OPEN switch command and whether it is the appropriate time (i.e., the appropriate timed interval along the AC voltage waveform) to initiate an open switch operation, in accordance with decision step 1078. If both of these conditions are met, in accordance with the "YES" path out of decision step 1078, the motion control routine 1071 for an OPEN switch operation is launched, as indicated by step 1080. Launching the motion control routine 1071 involves, among other things, loading an initial contact position (i.e., the total distance traveled by the contact(s) during the previous switching operation) and setting the motion control routine status flag, indicating that the motion control routine 1071 has been launched. If, however, both of the conditions associated with decision step 1078 are not met, in accordance with the "NO" path out of decision step 1078, the $T_{INT}$ interrupt routine 1070 determines whether the switching operation status flag(s) indicate the presence of an CLOSE switch command and whether it is the appropriate time (i.e., the appropriate timed interval along the AC voltage waveform) to initiate a close switch operation, in accordance with decision step 1081. If both of the conditions associated with decision step 1081 are met, in accordance with the "YES" path out of decision step 1081, the motion control routine 1071 for a CLOSE switch operation is launched, as indicated by step 1082. If both of the conditions associated with decision step 1081 are not met, in accordance with the "NO" path out of decision step 1081, the $T_{INT}$ interrupt routine 1070 then determines whether the $T_{INT}$ counter has decremented to zero, in accordance with decision step 1084. The $T_{INT}$ counter decrementing to zero indicates the end of the end of the present half-cycle of the AC voltage waveform. Accordingly, the $T_{INT}$ interrupt routine 1071 awaits the next zero-voltage crossover point and, consequently, the next $V_{INT}$ interrupt signal, signifying the onset of the next halfcycle of the AC voltage waveform. However, if it is determined that the $T_{INT}$ counter is not zero, in accordance with the "NO" path out of decision step 1084, the $T_{INT}$ interrupt routine 1070 sets up for the next $T_{INT}$ interrupt signal, as indicated by step 1086.

Once the motion control routine 1071 has been launched, in accordance with step 1080 or step 1082, the motion control routine 1071 proceeds by reading the present feedback position error and velocity from the feedback device 14, in accordance with step 1088. Initially, the feedback velocity is zero and the feedback position error is at its maximum value (i.e., equivalent to the initial contact position error value loaded during step 1080 or step 1082). Thereafter, feedback position error and velocity change as the contact 71 is moved during the switching operation.

Next, the motion control routine 1071 determines whether the position error is less than a predefined minimum value, in accordance with decision step 1090. The purpose of this step is to determine whether the switching operation is essentially complete. If it is determined that the position error is less than the predefined minimum value, in accordance with the "YES" path out of decision step 1090, the motion control routine 1071 terminates the feedback process, resets the various status flags and relinquishes control back to the $T_{INT}$ interrupt routine 1070, in accordance with step 1091, wherein the $T_{INT}$ interrupt routine 1070 awaits the next zero-voltage crossover point and the generation of the next $V_{INT}$ interrupt signal.

If it is determined that the position error is not less than the predefined minimum value, in accordance with the "NO" path out of decision block 1090, the motion control routine 1071 proceeds with calculating the current control signal, as indicated by step 1092. As explained above, the current control signal is computed as a function of the feedback position error, velocity and the transfer function. The current control signal, of course, is what controls the amount of current flowing through the voice coil winding 10 and thus the force exerted to move contact 71. The $T_{INT}$ interrupt routine 1070 then sets up for the next $T_{INT}$ interrupt signal, and the process repeats itself until the switching operation is completed simultaneous to a zero-voltage crossover point.

The present invention has been described with reference to a number of exemplary embodiments. However, it will be readily apparent to those skilled in the art that is possible to embody the invention in specific forms other than the exemplary embodiments described above, and that this may be done without departing from the spirit of the invention. The exemplary embodiments described hereinabove are merely illustrative and should not be considered restrictive in any way. The scope of the invention is given by the appended claims, rather than the preceding description, and all variations and equivalents which fall within the range of the claims are intended to be embraced therein.

What is claimed is:

1. A closed-loop feedback control system for electrical switchgear comprising:

a microprocessor;

a current generation means, operatively coupled to said microprocessor, for providing a driving current required to regulate an actuator for moving at least one of two switchgear contacts in the electrical switchgear; and a position feedback means, operatively coupled to the at least one of two contacts, for repeatedly sampling position information of the at least one of two contacts and providing contact position information to the microprocessor, wherein said microprocessor comprises means for controlling said current generation means in real-time, during a switching operation, as a function of an initial contact position and a present contact position, as provided by said position feedback means, such that the at least one contact transitions from the initial contact position to a final contact position in accordance with a pre-defined motion profile so as to provide AC waveform synchronized switching.

2. The closed-loop feedback control system of claim 1, wherein said means for controlling said current generation means comprises:

means for comparing switching operation performance data with the predefined motion profile during the switching operation; and means for modifying the motion profile of the at least one contact during the switching operation by adjusting a transfer function associated with the closed-loop feedback control system based on the comparison of the switching operation performance data and the pre-defined motion profile.

3. The closed-loop feedback control system of claim 1, wherein said microprocessor further comprises:

means for saving past switching operation performance data from one or more prior switching operations;

means for comparing the past switching operation performance data with a desired performance profile; and means for modifying the pre-defined motion profile by adjusting a transfer function associated with the closed-loop feedback control system, based on the comparison of the past switching operation performance data and the desired performance profile.

4. The closed-loop feedback control system of claim 1, wherein said means for controlling said current generation means comprises:

means for initiating the switching operation as a function of timing information associated with the AC waveform.

5. The closed-loop feedback control system of claim 4, wherein said means for controlling said current generation means further comprises:

means for saving past switching operation performance data from one or more prior switching operations; and means for adjusting said switching operation initiation means as a function of the past switching operation performance data.

6. The closed-loop feedback control system of claim 5, wherein the past switching operation performance data includes a measure of AC waveform synchronization.

7. The closed-loop feedback control system of claim 4, wherein the timing information includes one or more pulses, each being generated concurrent to and as a result of a corresponding zero crossover point along the AC waveform, and wherein a time period between consecutive pulses corresponds to a half-cycle of the AC waveform.

8. The closed-loop feedback control system of claim 7, wherein said means for controlling the current generation means further comprises:

means for generating zero crossover point interrupt signals concurrent to and as a result of each of the one or more pulses;

means for generating a pre-defined number of timing interval interrupt signals during the period between each zero crossover point interrupt signal, wherein said means for initiating the switching operation is launched concurrent to a pre-defined one of the timed interval interrupt signals.

9. The closed-loop feedback control system of claim 4, wherein the timing information includes a timing pulse generated concurrent to and as a result of a zero-voltage differential across the two switchgear contacts.

10. The closed-loop feedback control system of claim 1, wherein said position feedback means comprises:

means for providing the initial contact position for said current generation control means based on a total distance traveled by the at least one contact during a previous switching operation.

11. The closed-loop feedback control system of claim 1, wherein the actuator utilized for moving the at least one of two switchgear contacts is associated with a voice coil.

12. The closed-loop feedback control system of claim 1, wherein the actuator utilized for moving the at least one of two switchgear contacts is associated with a linear motor.

13. The closed-loop feedback control system of claim 1, wherein the actuator utilized for moving the at least one of two switchgear contacts is associated with a hydraulic unit.

14. The closed-loop feedback control system of claim 1, wherein the pre-defined motion profile comprises a profile of velocities at which the at least one contact should travel during a transition.

15. The closed-loop feedback control system of claim 1, wherein said microprocessor provides AC waveform synchronized switching by initiating the at least one contact to close or open when an AC value across the contacts is substantially zero.

16. The closed-loop feedback control system of claim 15, wherein the AC value is a current value.

17. The closed-loop feedback control system of claim 15, wherein the AC value is a voltage value.

18. The closed-loop feedback control system of claim 1, wherein position information of a contact comprises a position of the contact.

19. A capacitor switch comprising:

a current interrupter containing at least one moveable contact;

an actuator coupled to the at least one moveable contact;

a closed-loop feedback, motion control circuit comprising:

a microprocessor, a pulse-width modulation (PWM) circuit, operatively coupled to said microprocessor, wherein said PWM circuit produces driving current for said actuator which is required to drive the at least one moveable contact from an initial contact position to a final contact position during a switching operation, a position sensor optically coupled to the at least one contact to repeatedly sample position data of the at least one moveable contact, a decoder, wherein said decoder receives and decodes the contact position data from said position sensor and forwards the decoded contact position data to said microprocessor, wherein said microprocessor includes closed-loop feedback means for controlling contact position and velocity in real-time, during the switching operation, based on the initial contact position, a present contact position feedback signal and a present contact velocity feedback signal, such that the switching operation is synchronized with an AC voltage waveform across the capacitor switch.

20. The capacitor switch of claim 19, wherein said PWM circuit comprises:

a digital-to-analog converter; and a power amplifier.

21. The capacitor switch of claim 19, wherein said position sensor is an optical, quadrature encoder.

22. The capacitor switch of claim 19, wherein said closed-loop feedback means for controlling contact position and velocity comprises:

means for deriving the contact velocity feedback signal from the contact position feedback signal;

means for comparing the contact velocity feedback signal with a pre-defined motion profile; and means for adjusting the current produced by said PWM circuit as a function of the comparison between the contact velocity feedback signal and the pre-defined motion profile.

23. The capacitor switch of claim 22, wherein the pre-defined motion profile comprises a profile of velocities at which the at least one contact should travel over a duration of a switching operation.

24. The capacitor switch of claim 19, wherein said microprocessor further includes:

means for saving velocity feedback data associated with one or more prior switching operations;

means for comparing the velocity feedback data from the one or more prior switching operations with a pre-defined motion profile; and means for modifying the pre-defined motion profile by adjusting a transfer function associated with said closed-loop feedback motion control circuit based on the comparison between the velocity feedback data from the one or more prior switching operations and the pre-defined motion profile.

25. The capacitor switch of claim 19, further comprising:

an AC voltage waveform analysis circuit; and a capacitor switch control interface.

26. The capacitor switch of claim 25, wherein said microprocessor further comprises:

means for receiving timing information from said AC voltage waveform analysis circuit;

means for receiving a switching operation execute command from said capacitor switch control interface; and means for initiating the switching operation as a function of the timing information and the switching operation execute command.

27. The capacitor switch of claim 26, wherein said microprocessor further comprises:

means for saving switching operation performance data from one or more prior switching operations; and means for adjusting said switching operation initiation means based on the switching operation performance data from the one or more prior switching operations, wherein the switching operation performance data from the one or more prior switching operations includes a measure of AC voltage waveform synchronization.

28. The capacitor switch of claim 26, wherein the timing information includes a plurality of timing pulses, and wherein each timing pulse is generated by the AC voltage waveform analysis circuit concurrent to and as a function of a zero-voltage crossover point along the AC voltage waveform.

29. The capacitor switch of claim 28, wherein the timing information includes zero-voltage crossover interrupt signals, each being generated by said microprocessor concurrent to and as a result of a corresponding timing pulse.

30. The capacitor switch of claim 29, wherein the timing information includes a number of timed interval interrupt signals generated at equally-spaced intervals by the microprocessor during the period between consecutive zero-voltage interrupt signals.

31. The capacitor switch of claim 26, wherein the timing information includes a timing pulse associated with a zero-voltage differential across the capacitor switch contacts.

32. The capacitor switch of claim 19, wherein said actuator is associated with a voice coil.

33. The capacitor switch of claim 19, wherein said actuator is associated with a linear motor.

34. The capacitor switch of claim 19, wherein said actuator is associated with a hydraulic unit.

35. The capacitor switch of claim 19, wherein said microprocessor provides AC waveform synchronized switching by initiating the at least one contact to close or open when an AC voltage value across the contacts is substantially zero.

36. The capacitor switch of claim 19, wherein the decoder continuously receives and decodes the position data from the position sensor.

37. A closed-loop feedback method for controlling at least one contact in an electrical switchgear during a switching operation, said method comprising the steps of:

generating a driving current required to move the at least one contact;

generating contact position feedback in real-time, during the switching operation, by repeatedly receiving samples of a position of the at least one contact; and controlling the generation of driving current required to regulate the movement of the at least one contact in real-time, during the switching operation, as a function of an initial contact position and the real-time contact position feedback data, such that the at least one contact transitions from the initial contact position to a final contact position in accordance with a pre-defined motion profile so as to provide AC voltage or current waveform synchronized switching.

38. The method of claim 37, wherein said step of controlling the generation of driving current required to regulate the movement of the at least one contact in real-time, during the switching operation comprises the steps of:

deriving real-time contact velocity feedback data from the real-time contact position feedback data;

comparing the real-time contact velocity feedback data with a pre-defined motion profile; and adjusting the driving current required to regulate the movement of the at least one contact as a function of the comparison between the contact velocity feedback data and the pre-defined motion profile.

39. The method of claim 37 further comprising the steps of:

saving the contact velocity feedback data associated with one or more prior switching operations;

comparing the contact velocity feedback data from the one or more prior switching operations with a pre-defined motion profile; and modifying the pre-defined motion profile based on the comparison between the velocity feedback data from the one or more prior switching operations and the pre-defined motion profile.

40. The method of claim 37 further comprising the step of:

initiating the switching operation as a function of timing information and a switching operation execute command, wherein the timing information is associated with the AC voltage or current waveform.

41. The method of claim 40 further comprising the steps of:

saving switching operation performance data from one or more prior switching operations; and adjusting switching operation initiation based on the switching operation performance data from the one or more prior switching operations, wherein the switching operation performance data from the one or more prior switching operations includes a measure of AC voltage or current waveform synchronization.

42. The method of claim 40, wherein the timing information includes timing pulses, each associated with a zero-voltage or zero-current crossover point along the AC voltage or current waveform, respectively.

43. The method of claim 42, wherein the timing information includes zero-voltage or zero-current crossover interrupt signals, each being generated concurrent to and as a result of a corresponding timing pulse.

44. The method of claim 43, wherein the timing information includes a number of timed interval interrupt signals, each being associated with one of a plurality of equally-spaced timing intervals between adjacent zero-voltage or zero-current crossover interrupt signals.

45. The method of claim 40, wherein the timing information includes a timing signal associated with a zero-voltage differential across the switchgear contacts.

46. The method of claim 37, wherein the pre-defined motion profile comprises a profile of velocities at which the at least one contact should travel over a duration of a switching operation.

47. The method of claim 37, wherein providing AC voltage waveform synchronized switching comprises initiating the at least one contact to close or open when an AC voltage value across the contacts is substantially zero.

48. The method of claim 37, wherein providing AC current waveform synchronized switching comprises initiating the at least one contact to close or open when an AC current value across the contacts is substantially zero.

* * * * *